US008801449B2

(12) United States Patent
Huang et al.

(10) Patent No.: US 8,801,449 B2
(45) Date of Patent: Aug. 12, 2014

(54) LOWER PROFILE CARD EDGE CONNECTOR

(75) Inventors: Yong-Jian Huang, Kunshan (CN); Zhen-Hua Wang, Kunshan (CN); Hua Li, Kunshan (CN); Li-Dong Tang, Kunshan (CN)

(73) Assignee: Hon Hai Precision Industry Co., Ltd., New Taiepei (TW)

( * ) Notice: Subject to any disclaimer, the term of this patent is extended or adjusted under 35 U.S.C. 154(b) by 29 days.

(21) Appl. No.: 13/620,241

(22) Filed: Sep. 14, 2012

(65) Prior Publication Data

US 2013/0084753 A1 Apr. 4, 2013

(30) Foreign Application Priority Data

Sep. 30, 2011 (CN) ..... 2011 2 0369079

(51) Int. Cl.
*H01R 13/62* (2006.01)

(52) U.S. Cl.
USPC ..... 439/326; 439/570; 439/108

(58) Field of Classification Search
USPC ..... 439/326, 572, 563, 570, 108
See application file for complete search history.

(56) References Cited

U.S. PATENT DOCUMENTS 6,012,949 A * 1/2000 Lok ..... 439/570
6,022,244 A * 2/2000 Chiu ..... 439/570
6,132,248 A * 10/2000 Ramey ..... 439/570
6,280,247 B1 * 8/2001 Wu et al. ..... 439/570
6,579,122 B1 * 6/2003 Chen ..... 439/570
6,663,406 B1 * 12/2003 Wu ..... 439/326
6,824,425 B2 * 11/2004 Fan ..... 439/570
6,890,193 B2 5/2005 Kimura et al.
7,201,039 B2 * 4/2007 Morse et al. ..... 73/38
7,291,039 B2 * 11/2007 Shin ..... 439/495
7,458,822 B2 * 12/2008 Ono ..... 439/74
7,491,092 B2 * 2/2009 Zhu et al. ..... 439/633
7,727,010 B2 * 6/2010 Liu et al. ..... 439/570
7,785,149 B2 * 8/2010 Kamata et al. ..... 439/607.35
7,985,089 B2 * 7/2011 Zhu et al. ..... 439/326
8,388,373 B2 * 3/2013 Wang et al. ..... 439/570

FOREIGN PATENT DOCUMENTS

TW 585360 4/2004

* cited by examiner

*Primary Examiner* — Gary Paumen
(74) *Attorney, Agent, or Firm* — Wei Te Chung; Ming Chieh Chang

(57) ABSTRACT

A card edge connector for receiving a card which is rotatably assembled includes an insulative housing, a plurality of terminals and a pair of metal pieces. The insulative housing has a inserted slot for receiving the card and a key within the inserted slot for anti-mismating of the card. The terminals are arranged in a single row and located at one side of the inserted slot. Each terminal includes a solder portion extending out of the insulative housing and a contacting portion projecting into the inserted slot. The metal pieces locate at the other side of the inserted slot, each of which includes a mounting portion and an abutting portion projecting into the inserted slot. The terminals are arranged in a single row for reducing the height of the card edge connector.

17 Claims, 7 Drawing Sheets

LOWER PROFILE CARD EDGE CONNECTOR

BACKGROUND OF THE INVENTION

1. Field of the Invention

The present invention relates to an card edge connector, and more particularly to a card edge connector for receiving an electrical card.

2. Description of the Related Art

Taiwan Patent Issued Number 585360 issued on Apr. 21, 2004 discloses a card edge connector for receiving an electrical card. The card edge connector includes a longitudinal insulative housing and a pair of locking devices located on opposite ends of the insulative housing. The insulative housing includes a upper wall and a lower wall extending along a longitudinal direction, a rear wall connecting the upper wall and the lower wall, and an elongated slot located between the upper wall and the lower wall which defines a key for protecting the electrical card into the elongated slot in a correct direction. There are a number of conductive terminals received in the upper wall and the lower wall, respectively, to achieve an electrical connection with the contacts at the upper and lower sides of the electrical card when the electrical card is inserted.

As the number of the contacts of the upper and lower sides of the electrical card is the same, the number of the corresponding contacts of the upper wall and the lower wall of the connector is the same. The upper wall should have enough thickness to accommodate the conductive terminals which will increase the height of the card edge connector and is not conducive to the miniaturization of the card edge connector. Obviously, an improved card edge connector which can solve the problem is needed.

SUMMARY OF THE INVENTION

Accordingly, an object of the present invention is to provide a lower profile card edge connector.

In order to achieve the object set forth, a card edge connector for receiving a card which is rotatably assembled includes an insulative housing, a plurality of terminals and a pair of metal pieces. The insulative housing has a inserted slot for receiving the card and a key within the inserted slot for anti-mismating of the card. The terminals are arranged in a single row and located at one side of the inserted slot. Each terminal includes a solder portion extending out of the insulative housing and a contacting portion projecting into the inserted slot. The metal pieces locate at the other side of the inserted slot, each of which includes a mounting portion and an abutting portion projecting into the inserted slot. The terminals are arranged in a single row for reducing the height of the card edge connector.

Other objects, advantages and novel features of the invention will become more apparent from the following detailed description of the present embodiment when taken in conjunction with the accompanying drawings.

DETAILED DESCRIPTION OF THE INVENTION

Figure 1:
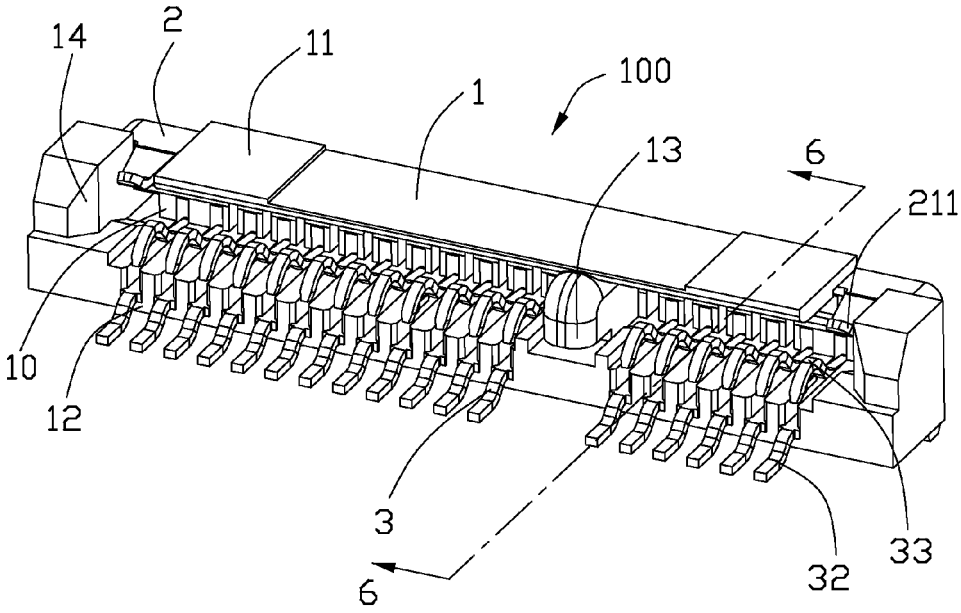
FIG. 1 is an assembled isometric view of a card edge connector in accordance with the present invention.

Reference will now be made to the drawing figures to describe preferred embodiments of the present invention in detail.

Figure 2:
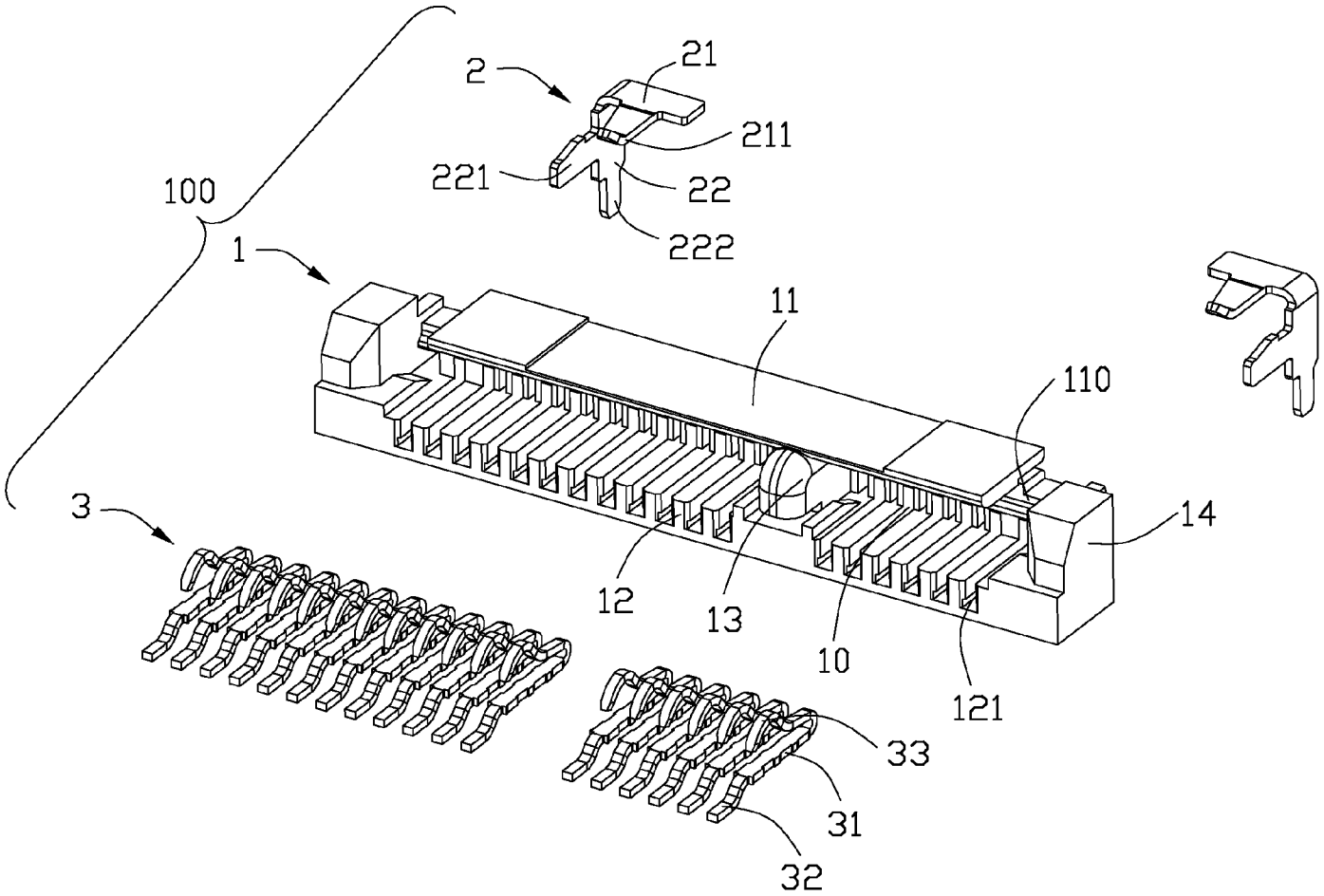
FIG. 2 is an exploded perspective view of the card edge connector.
Figure 3:
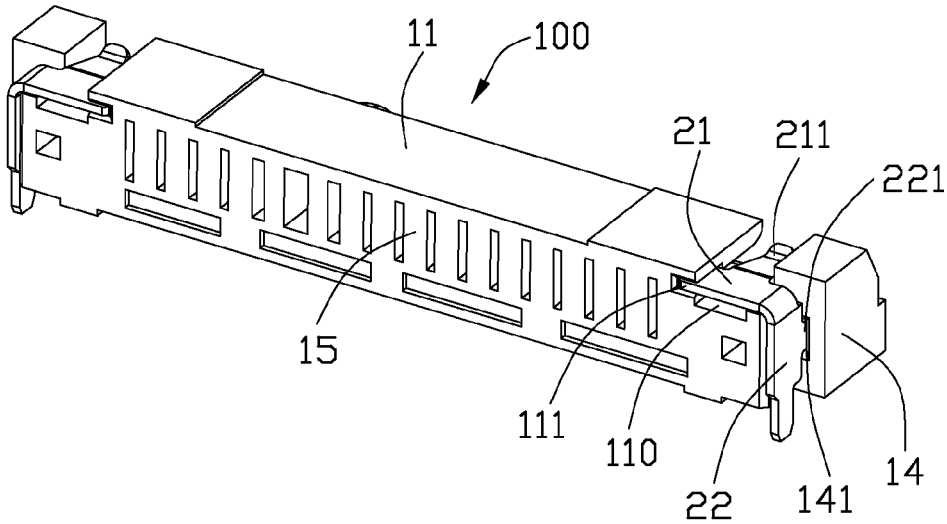
FIG. 3 is another exploded perspective view of the card edge connector.
Figure 4:
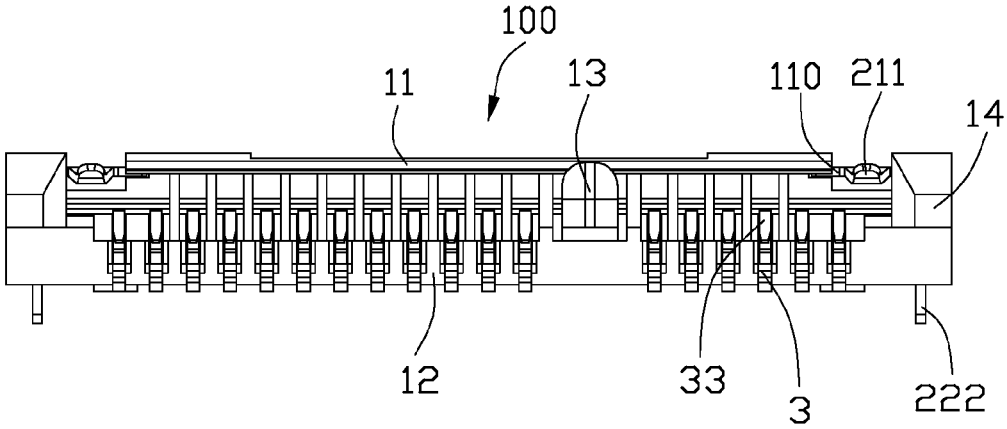
FIG. 4 is a front perspective view of the card edge connector shown in FIG. 1.

Referring to FIG. 1 to FIG. 3, a card edge connector 100 in accordance with the present invention is provided. The card edge connector 100 is used to receive an electrical card and soldered on a motherboard of an electrical device which can be a thin notebook computer or a Tablet PC or other similar slim electrical products, in order to achieve signal transmission between the electrical card and the motherboard. The card edge connector 100 comprises an insulative housing 1, a pair of metal pieces 2 locating on two opposite ends of the insulative housing 1 and a row of conductive terminals 3 disposing in the insulative housing 1.

Figure 5:
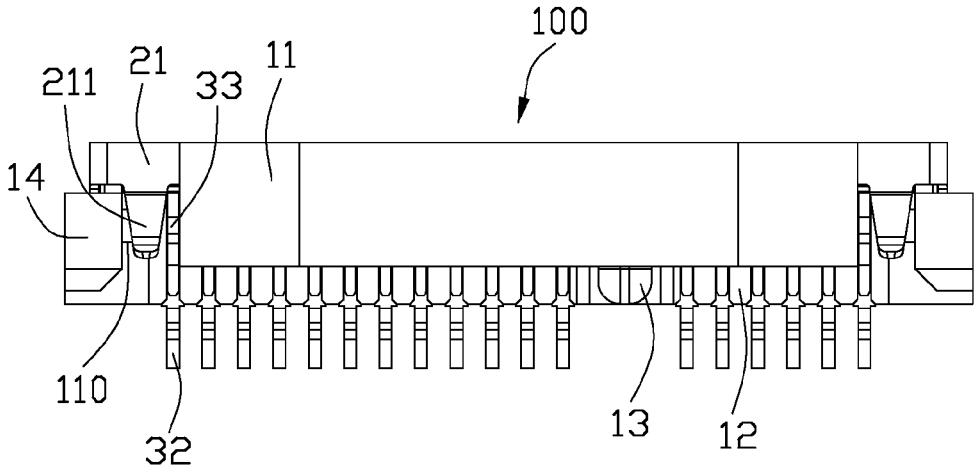
FIG. 5 is a top perspective view of the card edge connector shown in FIG. 1.

Referring to FIG. 1 and FIG. 5, the insulative housing 1 is configured to a longitudinal rectangular shape and includes an upper wall 11 and a lower wall 12 opposite with each other, a rear wall 15 connecting with the upper wall 11 and the lower wall 12, and a pair of sidewalls 14 locating in two longitudinal ends of the upper wall 11 and the lower wall 12. An inserted slot 10 locates between the upper wall 11 and the lower wall 12 for receiving an electrical card, the upper wall 11 is known as a first wall and the lower wall 12 is known as a second wall. A key 13 locates in the inserted slot 10 and near to one side of one sidewall 14 for protecting the electrical card into the inserted slot 10 in a correct direction. The lower wall 12 significantly projects forwardly from the upper wall 11 along the front and rear direction to form an opening port (unlabeled) in the front side of the inserted slot 10, the electrical card can be tilted inserted with less resistance by this way. The both sides of the upper wall 11 which near the sidewalls 14 are set separately and form a pair of recess portions 110 which connecting with the inserted slot 10 for receiving the metal pieces 2. A pair of retaining slots 111 extend forwardly and horizontally from one part of the rear wall 15 which near the recess portions 110 and connecting through the recess portions 110 at the rear end thereof. A clamping slot 141 extends forwardly from the rear end of the sidewalls 14 in the vertical direction.

The lower wall 12 defines a plurality of receiving passageways 121 in a longitudinal direction, and the receiving passageways 121 extend rearward from the front surface of the lower wall 12 and connecting through the inserted slot 10. In this embodiment, there is no receiving passageway located in the upper wall 11, the reasons are as following: firstly, it has higher signaling rates to arrange the conductive terminals in a single row; secondly, it is benefit for adapting the miniature trend of the card edge connector 100, in other words, we can reduce the height of the card edge connector 100 as best. The upper wall 11 does not have a large thickness to accommodate the conductive terminals because the upper wall 11 has no the conductive terminals, in this way, the upper wall 11 can be thinner to reduce the thickness of the card edge connector 100.

Figure 6:
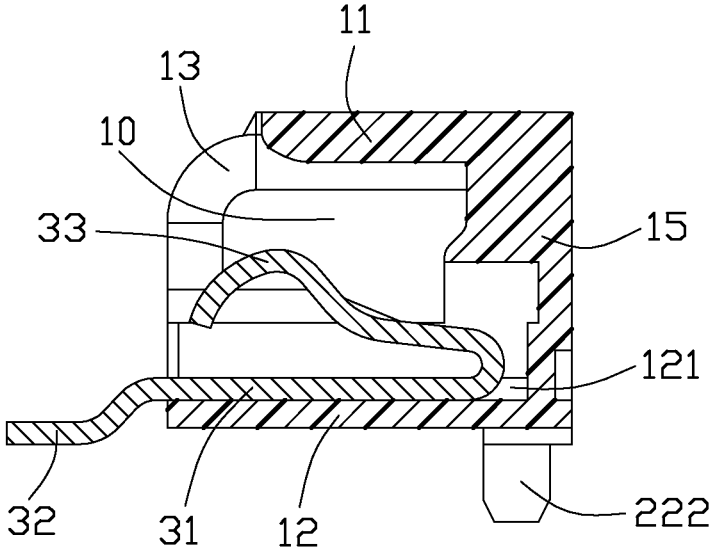
FIG. 6 is a cross sectional view of the card edge connector taken along line 6-6 in FIG. 1.

Referring to FIG. 1, FIG. 2 and FIG. 6, the conductive terminals 3 are formed by stamping and bending of the metal material which is a better conductive properties of material such as phosphor bronze. The terminals 3 are arranged in a single row and received in the receiving passageways 121 of the lower wall 12. Each terminal 3 comprises a main body 31 retaining in the receiving passageways 121, a contacting portion 33 bending forwardly from the rear end of the main body 31 and a surface-welding solder portion 32 extending from the front end of the main body 31 and exceeding the front surface of the lower wall 12. The contacting portion 33 extends into the inserted slot 10 for reaching an electrical conduction with the contacts of the electrical card.

Referring to FIG. 2 to FIG. 5, the metal pieces 2 are made by stamping and bending of a metal material which is a greater strength properties, such as stainless steel which is better than phosphor bronze. Each metal piece 2 includes a platy main portion 22, a mounting portion 222 extending downwardly from a bottom side of the main portion 22, a locking portion 21 bending inwardly from a top side of the main portion 22 and a retaining portion 221 extending forwardly from a front edge of the main portion 22. An elastic abutting portion 211 extends forwardly from the front edge of the locking portion 21 and is in a same direction with the retaining portion 221. The metal pieces 2 are installed in the recess portions 110 and the retaining portions 221 are retained in the clamping slots 141 of the sidewalls 14 and the rear end of the locking portions 21 are retained in the retaining slot 111. At the same time, the elastic abutting portion 211 projects into the inserted slot 10 and to press the electrical card. The retaining portion 221 and the locking portions 21 are perpendicular to each other so that the metal pieces 2 have a good strength after being mounted. Referring to FIG. 5, the width of the metal piece 2 is significantly greater than the width of the conductive terminal 3, therefore the metal piece 2 has a better strength, which is not only conducive to enhance the stability when the card edge connector 100 is mounted on the circuit board but also conducive to enhance the pressure of the electrical card when the electrical card is mounted. At the same time, the mounting portion 222 locates in the rear end of the insulative housing 1 and ensures the balance of the card edge connector 100 when the card edge connector 100 is mounted on the circuit board.

The electrical card can make a repulsion against the upper wall 11 when it is inserted and rotatably assembled because of the upper wall 11 is thinner, the upper wall 11 may be damaged because of larger repulsion if there is no metal piece 2. Therefore, a pair of metal pieces 2 in accordance with the present invention is provided, the repulsion will act on the elastic abutting portions 211 of the metal pieces 2 when the electrical card is inserted and rotatably assembled. Because the metal pieces 2 has a better strength, the repulsion of the electrical card will be absorption by the elastic abutting portions 211 of the metal pieces 2, so that the card edge connector 100 has a better stability.

Figure 7:
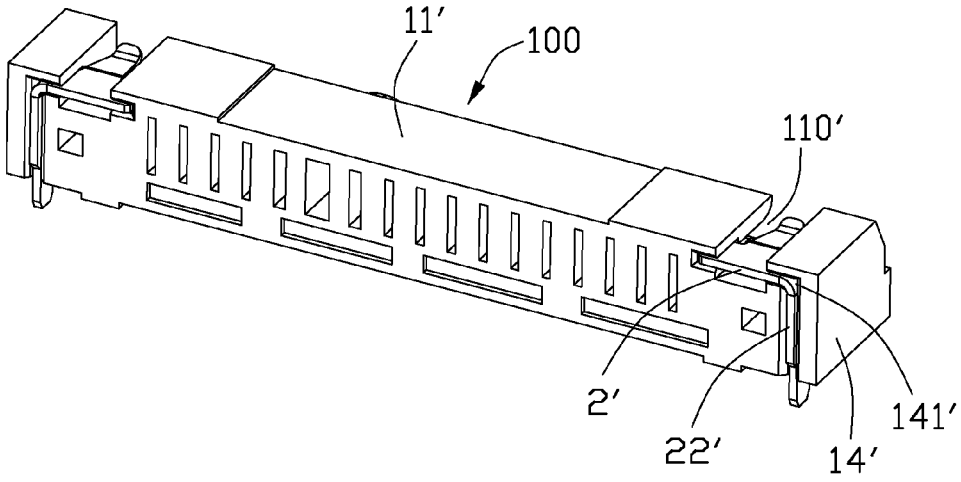
FIG. 7 is another embodiment of the card edge connector shown in FIG. 1.

For mounting the metal pieces 2 expediently, one portion of the rear side of the sidewall 14 is cut so that main portion 22 is exposed. Referring to FIG. 7, one portion of the rear side of the sidewall 14 is not removed in an alternative embodiment, the recess portion 110' still locates between the upper wall 11' and the sidewall 14' which has a complete structure, the clamping slots 141' extend forwardly from the rear surface of the sidewall 14' which is flush with the upper wall 11', and the metal pieces 2' are received into the clamping slots 141' completely. In this way, the metal pieces 2' have a better retaining effect and it can prevent the metal pieces 2' rotating when assembled the electrical card.

Although, the metal pieces 2 locate in one side of the upper wall 11 and the terminals 3 locate in one side of the lower wall 12 in this embodiment, but the metal pieces 2 can also locate in one side of the lower wall 12 and the terminals 3 locate in a side of the upper wall 11. The card edge connector 100 can also set to a sink type, for example, the mounting surface is formed by the solder portion 32 of the terminals 3 and the mounting portion 222 of the metal pieces 2 is higher than the bottom of the insulative housing 1, which can save more space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector for receiving a card which is rotatably assembled, comprising:

an insulative housing defining a longitudinal insertion slot for receiving a card and a key within the insertion slot for anti-mismating of the card;

a plurality of terminals arranged in a single row and located at one side of the insertion slot, each terminal including a solder portion extending beyond of the insulative housing and a contacting portion projecting into the insertion slot;

a pair of metal pieces located at the other side of the insertion slot;

wherein each metal piece includes a mounting portion extending beyond the insulative housing and an abutting portion projecting into the inserted slot;

wherein the metal pieces are located in two opposite ends of the insertion slot in the longitudinal direction;

wherein the housing further including a first wall located in one side of the insertion slot and the terminals received in the receiving passageways of the first wall, a second wall located in another side of the insertion slot and a pair of recess portions disposed at opposite ends of the second wall for receiving the metal pieces in the longitudinal direction;

wherein the length of the first wall is different from the length of the second wall in a front-to-back direction that forming a sloping insertion ort on the front of the insertion slot.

2. The card edge connector as described in claim 1, wherein the metal piece is mounted along the back-to-front direction with the mounting portion located in a rear end of the insulative housing, the solder portion of the terminal is surface-mount type and locates at a front end of the insulative housing.

3. The card edge connector as described in claim 1, wherein a pair of sidewalls locate on both ends of the first wall and the second wall respectively and each sidewall defines a clamping slot in the back-to-front direction, a rear wall locates in a rear end of the first and second wall and defines a retaining slot connecting the recess portion, and the metal piece defines a retaining portion retained in the clamping slot and a locking portion received in the retaining slot.

4. The card edge connector as described in claim 3, wherein the retaining portion and the locking portion are perpendicular with each other.

5. The card edge connector as described in claim 1, wherein the material strength of the metal piece is larger than the material strength of the terminal.

6. The card edge connector as described in claim 5, wherein the metal piece is a grounding piece and its size is larger than the size of the terminal.

7. The card edge connector as described in claim 6, wherein the solder portion of the terminal and the mounting portion of the metal piece form a mounting surface that is higher than the bottom of the insulative housing.

8. A card edge connector, comprising:

an insulative housing having a first wall and a second wall along a longitudinal direction and defining an insertion slot therebetween and a key within the insertion slot, the insertion slot located at a front of the insulative housing;

a plurality of terminals arranged in a single row and assembled in the first wall from a front end of the insulative housing to a rear end thereof, and each terminal defining a contacting portion projecting into one side of the insertion slot;

a pair of metal pieces located at the other side of the insertion slot;

wherein the second wall does not have conductive terminals arranged.

9. The card edge connector as described in claim 8, wherein each terminal includes a main body and the contacting portion bending forwardly from the rear end of the main body, the main body is retained in the second wall and the contacting portion stretches the second wall and projects into the inserted slot.

10. The card edge connector as described in claim 9, wherein the terminals also can be assembled from the rear end of the second wall to the front end thereof.

11. The card edge connector for mounting to a printed circuit board and receiving a card edge module, comprising:

an elongated insulative housing defining, along a lengthwise direction, a receiving slot between upper and lower side walls in a vertical direction perpendicular to said lengthwise direction;

a plurality of terminals disposed in the housing with contacting sections exposed into the receiving slot around one of the upper and lower side walls; and a pair of metal pieces mounted at two opposite ends of the housing in said lengthwise direction, each of said metal pieces defining a mounting portion extending downwardly out of a seating face of the housing for mounting to the printed circuit board, and a resilient abutting portion extending into the receiving slot around the other of the upper and the lower side walls;

wherein the terminals and the pair of pieces generate forces opposite to each other in the vertical direction for sandwiching the card edge module received in the receiving slot under condition that each of the metal pieces is dimensioned and configured to be thicker and stiffer than each of the terminals.

12. The card edge connector as claimed in claim 11, wherein each of the terminals extends and lies in a vertical plane while each of the metal pieces extends with an L-shaped configuration having a horizontal section and a vertical section under condition that the abutting portion extends generally on the horizontal section while the mounting portion extends on the vertical section.

13. The card edge connector as claimed in claim 12, wherein each of said metal pieces further includes a retention portion for securing to the housing, and said retention portion extends on the vertical section.

14. The card edge connector as claimed in claim 11, wherein the other of the upper and lower side walls defines a pair of recessed portions accommodating deflection of the abutting portions of the pair of metal pieces, respectively.

15. The card edge connector as claimed in claim 11, wherein the terminals and the housing are configured to have the terminals assembled rearwardly, from a front face of the housing, into the housing in a front-to-back direction perpendicular to both said lengthwise direction and said vertical direction, while the metal pieces and the housing are configured to have the metal pieces assembled forwardly, from a rear face of the housing, into the housing in said front-to-back direction.

16. The card edge connector as claimed in claim 11, wherein the terminals are assembled into the lower side wall while the abutting portion is located around the upper side wall.

17. The card edge connector as claimed in claim 11, wherein said pair of metal pieces are symmetrically arranged with each other.

* * * * *